US005131873A

United States Patent [19]

Gierut et al.

[11] Patent Number: 5,131,873

[45] Date of Patent: Jul. 21, 1992

[54] FEMALE ELECTRICAL TERMINAL

[75] Inventors: Fred Gierut, Tinley Park; Robert H. Rushton, Villa Park, both of Ill.

[73] Assignee: Molex Incorporated, Lisle, Ill.

[21] Appl. No.: 580,699

[22] Filed: Sep. 11, 1990

[51] Int. Cl.[5] ..... H01R 11/22

[52] U.S. Cl. ..... 439/851; 439/746

[58] Field of Search ..... 439/842, 745, 746, 851-857, 439/861, 862

[56] References Cited

U.S. PATENT DOCUMENTS

| | | | |
|---|---|---|---|
| 4,168,880 | 9/1979 | Tesch | 439/839 |
| 4,304,457 | 12/1981 | Lissau | 439/851 |
| 4,550,972 | 11/1985 | Romak | 439/851 |
| 4,666,227 | 5/1987 | Galizia et al. | 439/851 |
| 4,906,212 | 3/1990 | Mixon, Jr. | 439/857 |
| 4,938,720 | 7/1990 | Romak | 439/839 |

FOREIGN PATENT DOCUMENTS

| | | | |
|---|---|---|---|
| 334989 | 9/1930 | United Kingdom | 439/851 |

*Primary Examiner*—David L. Pirlot

*Attorney, Agent, or Firm*—Louis A. Hecht; Stephen Z. Weiss; A. A. Tirva

[57] ABSTRACT

A stamped and formed metal female electrical terminal includes a generally cylindrical, formed portion defining a substantially unobstructed pin receiving mating end. The mating end includes a first longitudinal slot defined by opposed edges of the metal from which the terminal is formed and extending inwardly from the mating end. A second longitudinal slot is stamped from the metal of the terminal, diametrically opposed to the first slot. The second slot is completely closed and extends inwardly from a point spaced rearwardly from the pin receiving mating end.

3 Claims, 2 Drawing Sheets

FEMALE ELECTRICAL TERMINAL

FIELD OF THE INVENTION

This invention generally relates to the art of electrical connectors and terminals and, particularly, to a female terminal forming a receptacle for a male terminal pin.

BACKGROUND OF THE INVENTION

Female terminals, quite often fabricated as metallic stamped and formed members, are used in a wide variety of electrical connector applications ranging from conventional mateable connectors to plug-in connectors for printed circuit boards. The female terminals provide conductive receptacles for male terminal pins of a mating connector, for instance.

One typical type of female terminal is a stamped and formed female crimp terminal having a crimpable conductor engaging end and an opposed pin receiving mating end. The terminal is stamped from metal material and the mating end is formed or rolled into a generally cylindrical configuration dimensioned to resiliently engage a pin terminal inserted therein. The pin receiving mating end, due to its method of manufacture, includes a longitudinally extending slot defined by opposed edges of the metal from which the terminal is formed. The slot usually extends longitudinally inwardly from the mating end of the terminal to facilitate resilient deformation of the mating end in response to insertion forces of the pin terminal. An example of such a stamped and formed female terminal is shown in U.S. Pat. No. 3,621,445 to Horecky, dated Nov. 16, 1971 and assigned to the assignee of this invention.

Over the years, there simply has been provided a myriad of such female terminals as described above for a wide range of applications. Yet, problems still arise in providing precise, calculatable insertion forces for the pin terminal in the female terminal, as well as preventing damage to the pin terminal which could effect the characteristics of the circuit through the terminals. This is particularly true with the ever increasing tendency of miniaturization in the electrical/electronics art.

More particularly, there are constant attempts to decrease the insertion forces involved while still maintaining good electrical connection between the female and male terminals. The most popular type of female terminal is shown in the Horecky patent, above, wherein the rolled cylindrical configuration of the female terminal is provided with one or more inwardly projecting resilient tongues formed from a cut-out in the cylindrical walls of the mating and of the female terminal. Such tongues actually are the parts of such female terminals which most affect the insertion force required on the mating pin terminal. In essence, such resilient tongues increase the insertion force of an otherwise unobstructed round or cylindrical receptacle provided by the mating end of the female terminal. Although the Horecky terminal has proven quite effective for its intended purposes, there are applications where an unobstructed mating end of the female terminal is more desirable.

Attempts at providing an unobstructed mating end of a female terminal wherein insertion forces are decreased yet controllable have involved such configurations as forming a second longitudinal slot which extends inwardly from the distal end of the mating end of the terminal to form sort of a bifurcated mating end. Those configurations present considerable problems, particularly with miniature circuits, in creating additional edges which have a tendency to score or damage mating pin terminals. Such damage also is possible with female terminals employing inwardly directed resilient tongues, as described above.

This invention is directed to solving the above problems and satisfying the need of a new female terminal which has an unobstructed pin receiving mating end, yet the terminal is provided with means for decreasing the insertion force required on the pin terminal.

SUMMARY OF THE INVENTION

An object, therefore, of the invention is to provide a new and improved female electrical terminal.

In the exemplary embodiment of the invention, generally, the female terminal includes a generally cylindrical portion defining an unobstructed cylindrical pin receiving mating end. The mating end has an open-ended longitudinal slot defined by opposed longitudinal edges and at least one closed longitudinal slot defined by a continuous closed edge.

As disclosed herein, the female terminal is a stamped and formed metal component. The unobstructed pin receiving mating end is rolled into a generally cylindrical configuration to form a first longitudinal slot defined by opposed edges of the metal from which the terminal is formed and extending inwardly from the distal end of the mating end. The invention contemplates a second longitudinal slot which is completely closed and is stamped from the metal of the terminal, diametrically opposed to the first slot, and extending inwardly from a point spaced rearwardly from the distal end of the pin receiving mating end. The completely closed slot has proven effective to decrease the insertion force required by a mating pin terminal, yet the mating end remains unobstructed, devoid of any inwardly directed resilient tongues and presents minimal edges which might damage the pin terminal.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the following description taken in conjunction with the accompanying drawings, in which like reference numerals identify like elements in the figures and in which:

DETAILED DESCRIPTION

Figure 1:
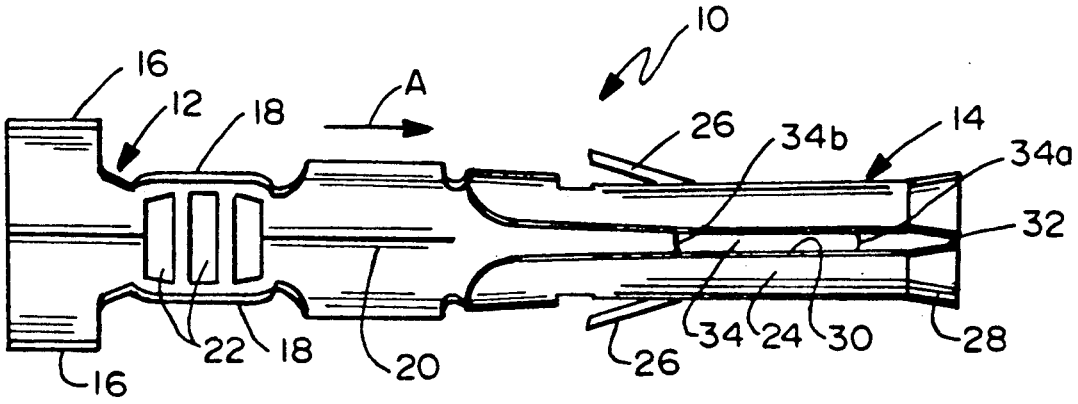
FIG. 1 is a top plan view of a female terminal embodying the concepts of the invention.
Figure 2:
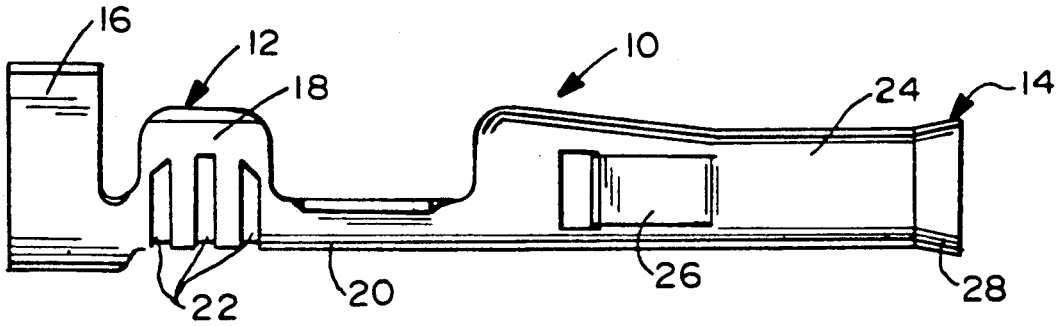
FIG. 2 is a side elevational view of the female terminal of FIG. 1.
Figure 3:
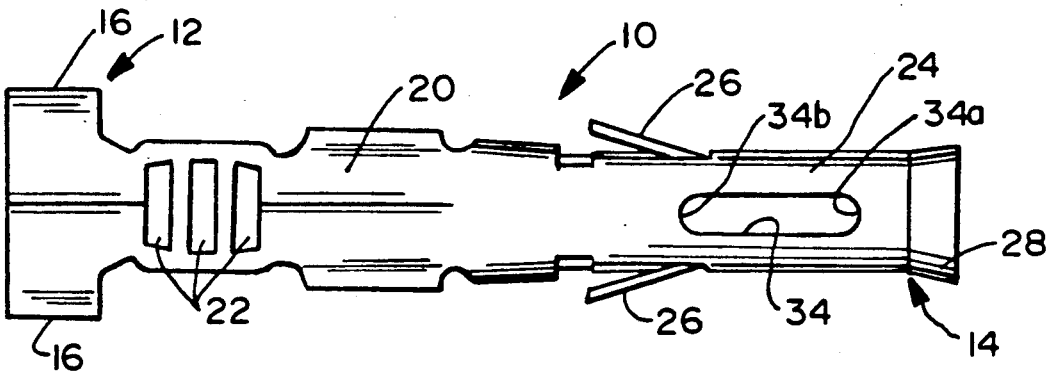
FIG. 3 is a bottom plan view of the female terminal of FIG. 1.

Referring to the drawings in greater detail, and first to FIGS. 1-3, the invention is embodied in a female electrical terminal, generally designated 10. FIG. 1 has been described as a top plan view solely for reference purposes in describing the orientation of FIGS. 2 and 3. In fact, terminal 10 is omnidirectional. In the illustrated embodiment, the female terminal is a stamped and formed metal component having a crimpable conductor engaging end, generally designated 12, and an opposed pin receiving mating end, generally designated 14.

More particularly, crimpable conductor engaging end 12 includes two pairs of crimp arms 16 and 18, respectively, which project upwardly from a bottom base 20 of the unitary terminal Crimp arms 16 are provided for crimping onto the insulation of an electrical wire, and crimp arms 18 are provided for crimping onto the conductor of the wire to establish conductivity between the conductor and the terminal. Inwardly directed ribs 22 are stamped into base 20 and partially into crimp arms 18 to provide gripping means on the conductor of the electrical wire when arms 18 are crimped thereto.

Pin receiving mating end 14 is formed, as by a rolling operation, into a generally cylindrical portion 24 having outwardly projecting latch arms 26 stamped and formed from the metal material of the terminal for resiliently engaging, as by a snapping action, appropriate latch shoulders of a dielectric housing (not shown) into which the terminal is inserted, such as in the direction of arrow "A". Mating end 14 has a radially outwardly flared mouth 28 which defines the distal end of the terminal into which a complementary male terminal or contact pin is inserted.

Pin receiving mating end 14 includes a longitudinally extending slot 30 (FIG. 1) defined by opposed edges of the metal material from which the terminal is formed, as by the aforesaid rolling operation. This first slot is open ended, as shown, and extends inwardly entirely from the distal end, as at 32, of mating end 14 of the terminal to facilitate resilient deformation of the mating end in response to insertion forces of a complimentary pin terminal.

The invention contemplates that a second longitudinal slot 34 (FIGS. 1 and 3) be provided for decreasing the insertion forces required of a pin terminal. As seen best in FIG. 3, slot 34 is a completely closed slot defined by a continuous closed edge which, in turn, defines closed ends 34*a* and 34*b*. In contrast to slot 30, slot 34 does not extend entirely from the distal end of the terminal mating end 14. In contrast, second slot 34 is stamped from the metal material of the terminal beginning at a point, defined by end 34*a*, spaced rearwardly or inwardly from the extreme or distal mating end of the terminal. In the preferred embodiment of the invention, one closed slot 34 is provided diametrically opposed to open-ended slot 30, as seen in comparing FIGS. 1 and 3.

It can be seen from the drawings and the above description, that mating end 14 of female terminal 10 is unobstructed on the interior thereof throughout the entire length of cylindrical portion 24. In other words, the cylindrical portion is void of any inwardly directed resilient tongues as is prevalent with the prior art. In addition, only one slot 30 is provided which opens into mouth 28 at the distal end of the terminal mating end to present a minimum of edges which could possibly damage a mating pin terminal, i.e., slot 30 being inherently formed during the rolling operation of the stamped and formed terminal. Slot 34, while decreasing the insertion forces of the pin terminal, does not present any open edges to the pin terminal.

Figure 4:
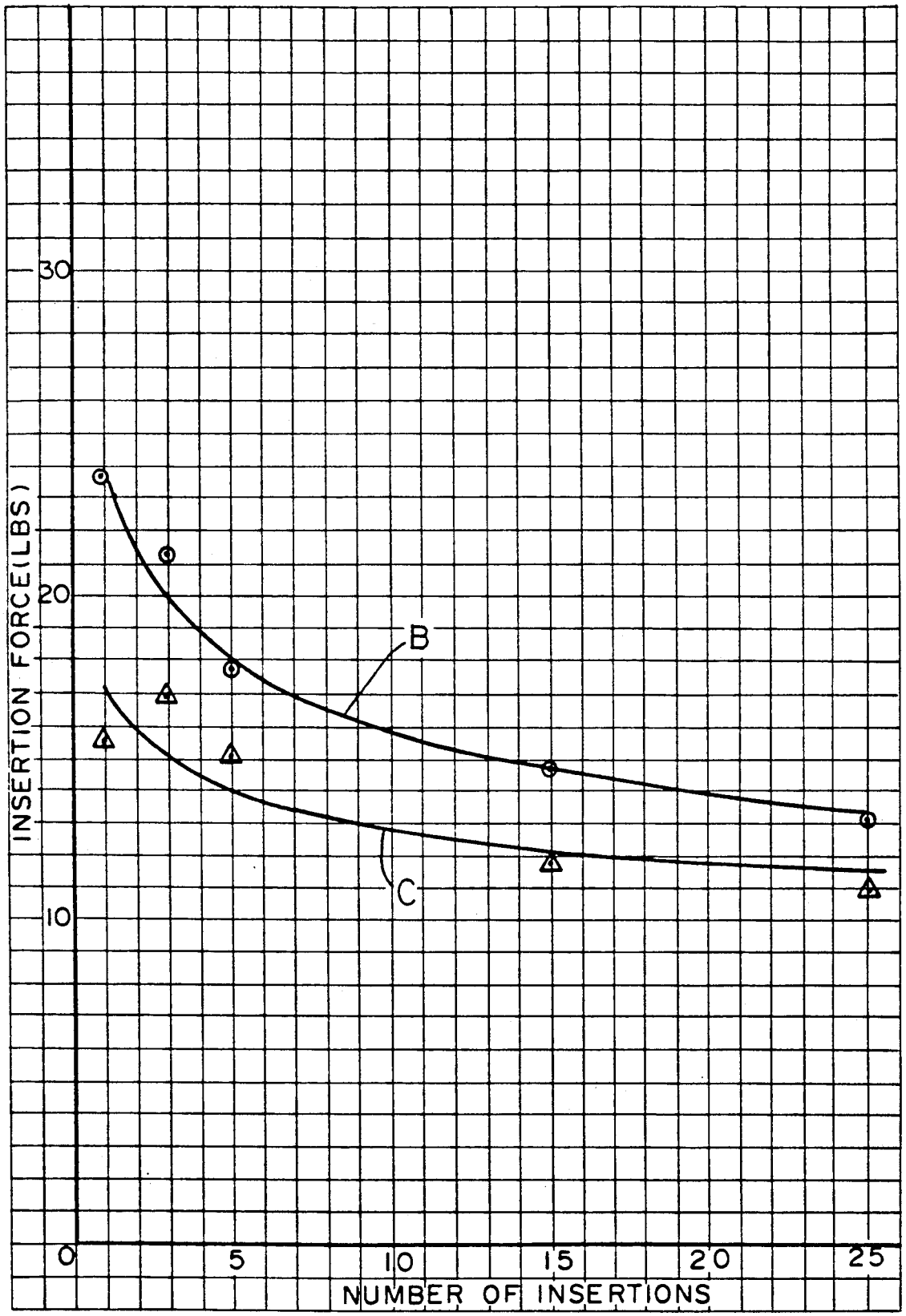
FIG. 4 is a graph illustrating the effectiveness of the invention.

It has been found that the design of this invention provides significantly lower insertion forces as compared to a stamped and formed pin receiving terminal having a substantially solid cylindrical portion 24, i.e., other than open-ended slot 30. To that end, FIG. 4 represents a graph of actual testing of the invention with and without closed-ended slot 34. More particularly, as shown, the graph charts the number of insertions in the horizontal direction and the insertion force in a vertical direction. Line B on the graph charts the gradually decreasing insertion force, versus number of insertions, of female terminals fabricated identically as shown in FIGS. 1 and 3, but without closed-ended slot 34. Line C on the graph charts the gradually decreasing insertion force, versus number of insertions, of female terminals fabricated identically as shown in FIGS. 1 and 3, but with closed-ended slot 34 formed as described. It can be seen that the two lines follow generally the same pattern of decreasing insertion forces as the number of repeated insertions increase, but there is shown a significant decrease in the required insertion force throughout the entire pattern when slot 34 is provided in the female terminals. The degree of this reduction is unexpected.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. A stamped and formed metal female electrical terminal comprising:

a generally cylindrical formed portion defining an unobstructed cylindrical receptacle extending therefrom, for receiving a pin having a diameter substantially equal to or greater than the diameter of the cylindrical receptacle, and including a first longitudinal slot defined by opposed edges of the metal from which the terminal is formed and extending inwardly from the mating end the length of the cylindrical receptacle, whereby the slot allows the cylindrical receptacle to resiliently deform by opening up of the slot upon insertion of such a pin into the receptacle;

a second longitudinal slot stamped from the metal of the terminal in a closed shape diametrically opposed to the first slot and extending inwardly a predetermined distance from a point spaced rearwardly from the pin receiving mating end whereby formation of the second slot by removal of material directly opposite the first slot decreases the tension and compression forces developed during the resilient deformation of the cylindrical receptacle which forces oppose the resilient deformation of the cylindrical receptacle; and a pair of diametrically opposed latching tabs having a free end and an attached end stamped from the metal of the terminal and formed so that its free end projects radially outwardly of the cylindrical portion, the latching tabs being located generally 90° circumferentially from the first and second slots and the attached end of the latching tabs attached to the cylindrical receptacle at a point which is within the range of the inwardly extending distances from the pin receiving mating end of the second longitudinal slot.

2. The female terminal of claim 1 wherein said pi receiving mating end has a radially outwardly flared mouth and wherein said first and second longitudinal slots are substantially parallel to the longitudinal axis of the cylindrical portion.

3. The female terminal of claim 1, including a conductor crimping portion at an end of the terminal opposite said pin receiving mating end the crimping portion having a plurality of ribs for engaging said conductor.

* * * * *